US007837854B2

(12) United States Patent
Ou et al.

(10) Patent No.: US 7,837,854 B2
(45) Date of Patent: Nov. 23, 2010

(54) PROCESS AND APPARATUS FOR UPGRADING STEAM CRACKED TAR

(75) Inventors: John D. Y. Ou, Houston, TX (US); Glenn A. Heeter, The Woodlands, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 342 days.

(21) Appl. No.: 12/023,204

(22) Filed: Jan. 31, 2008

(65) Prior Publication Data

US 2009/0194458 A1 Aug. 6, 2009

(51) Int. Cl.
*C10C 1/19* (2006.01)

(52) U.S. Cl. ..... 208/44; 208/95; 208/86; 208/309

(58) Field of Classification Search ..... 208/86, 208/95, 309, 44
See application file for complete search history.

(56) References Cited

U.S. PATENT DOCUMENTS 3,310,484 A * 3/1967 Mason et al. ..... 208/125
3,622,502 A 11/1971 Mason et al.
3,691,058 A 9/1972 Hamner et al.
3,707,459 A * 12/1972 Mason ..... 208/76
3,725,242 A 4/1973 Hamner et al.
3,923,921 A 12/1975 Kohfeldt
4,363,716 A 12/1982 Greene et al.
4,414,095 A 11/1983 Dickakian
4,414,096 A 11/1983 Dickakian
4,575,413 A 3/1986 Pizzoni et al.
5,215,649 A 6/1993 Grenoble et al.
5,443,715 A 8/1995 Grenoble et al.
6,025,530 A 2/2000 Dyckman et al.
2007/0007170 A1 * 1/2007 Strack et al. ..... 208/106
2009/0255852 A1 * 10/2009 Ou et al. ..... 208/67

FOREIGN PATENT DOCUMENTS

DE 43 08 507 9/1993

OTHER PUBLICATIONS

Behar, Hydrogen-Transfer Reactions in the Thermal Cracking of Asphaltenes, Energy&Fuels 1988, vol. 2, No. 3, 1988, pp. 259-264.*

* cited by examiner

*Primary Examiner*—Glenn A Caldarola
*Assistant Examiner*—Michelle L Stein

(57) ABSTRACT

A process and apparatus are provided for upgrading steam cracked tars. The invention also relates to a steam cracking process and apparatus for reducing the yields of tars produced from steam cracking while increasing yields of higher value products, heating cooled steam cracker tar containing asphaltenes, to a temperature, e.g., above about 300° C., which is sufficient to convert at least a portion of the steam cracked tar to lower boiling molecules. The resulting heat-treated tar can be separated into gas oil, fuel oil and tar streams.

13 Claims, 1 Drawing Sheet

PROCESS AND APPARATUS FOR UPGRADING STEAM CRACKED TAR

FIELD

The present invention relates to the cracking of hydrocarbons, especially with feeds containing relatively non-volatile hydrocarbons, which results in the formation of steam cracked tar. More particularly, the present invention relates to a cracking process and apparatus which treats steam cracker tar fractions by exposure to heating conditions for a time sufficient to convert high boiling molecules, e.g., asphaltenes, to lower boiling molecules. The resulting heat-treated tar can be separated to produce lower-boiling streams such as naphtha, gas oil, fuel oil, etc.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace that has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products, including olefins, leave the pyrolysis furnace for further downstream processing.

Pyrolysis involves heating the feedstock sufficiently to cause thermal decomposition of the larger molecules. The pyrolysis process, however, produces molecules that tend to combine to form high molecular weight materials known as tar. Tar is a high-boiling point, viscous, reactive material that can foul equipment under certain conditions. In general, feedstocks containing higher boiling materials tend to produce greater quantities of tar.

Conventional steam cracking systems have been effective for cracking high-quality feedstock which contains a large fraction of light volatile hydrocarbons, such as ethane, and naphtha. However, steam cracking economics sometimes favor cracking lower cost heavy feedstocks such as, by way of non-limiting examples, gas oil, crude oil and atmospheric residue. Gas oil, crude oil and atmospheric residue often contain high molecular weight, non-volatile components with boiling points in excess of about 590° C. (1100° F.) otherwise known as resids.

Cracking heavier feeds, such as residues, kerosenes and gas oils, produces large amounts of tar, which typically contains high-boiling and/or non-volatile components including paraffin-insoluble compounds, such as pentane-insoluble (PI) compounds or heptane-insoluble (HI) compounds, which are molecules of high molecular weight with multi-ring structures, e.g., asphaltenes. These materials reduce the economic value of tar by rendering it highly viscous and less compatible for mixing with highly paraffinic streams, inducing precipitation of the paraffin-insoluble components from the resulting mixture.

Various methods are known in the art to treat tars produced from steam cracking.

U.S. Pat. No. 3,691,058, incorporated herein by reference in its entirety, discloses an integrated visbreaking-hydrocracking process to break down steam cracked tars into single-ring aromatics.

U.S. Pat. No. 3,707,459, incorporated herein by reference in its entirety, discloses visbreaking residua, e.g., thermal tar from steam cracking, in the presence of free radical acceptors, e.g., CaO, isooctane, and n-heptane.

U.S. Pat. No. 4,575,413, incorporated herein by reference in its entirety, discloses adding aluminum salts to reduce fouling in steam cracked tar streams.

DE 4308507 discloses reducing viscosity of heavy oil residues by treatment at high temperature (427° C.) with a hydrogen donor solvent comprising a fuel oil from steam cracking, which contains hydroaromatic compounds.

U.S. Pat. No. 5,215,649, incorporated herein by reference in its entirety, discloses producing gaseous olefins by cracking a hydrocarbon feedstock stream wherein the cracked product stream is quenched to stop cracking, followed by injecting hydrogen donor diluent, e.g., dihydronaphthalenes, which suppress molecular weight growth reactions forming undesirable high molecular weight materials such as asphaltenes. The '649 patent (paragraph bridging columns 5 and 6) teaches steam cracked liquid product contains "free radical molecules, vinyl-aromatic molecules, and other reactive species, and is highly reactive at moderately high temperatures commonly found in the downstream processing of steam cracked liquid product." Steam cracked product is cooled in a heat soaking vessel to a temperature of 149° to 401° C. (300° to 755° F.) and hydrogen donor diluent is introduced to the heat soaking vessel at a temperature within 260° to 482° C. (500° to 900° F.) (column 6, lines 34 to 66). Quench oil can be added with the hydrogen donor diluent to form a quenched mixture temperature within the range of 260° to 343° C. (500° to 650° F.) (column 6, lines 59 to column 7, line 10).

It would be desirable to provide an apparatus and process to convert steam cracker tar to more valuable, lower boiling materials. Moreover, it would be particularly desirable to provide such an apparatus and process which are self-contained, treating steam cracker tars without adding additional materials such as hydrogen, hydrogen donors, or aluminum compounds.

SUMMARY

It has now been found that the yields of tar from a steam cracking process can be reduced and that the remaining tar can be reduced in asphaltene content by subjecting steam cracked tar to a heating process, without adding hydrogen, hydrogen donors, reducing materials, or other additives to the steam cracked tar.

In one aspect, the present invention relates to a process for upgrading steam cracked tar containing asphaltenes that comprises: a) heating the steam cracked tar from below 300° C. to a temperature above 300° C. and for a time, sufficient to convert at least a portion of the steam cracked tar to lower boiling molecules; and b) separating the heated steam cracked tar of a) into i) at least one tar-lean product; and ii) a tar-rich product boiling above the tar-lean product. The "tar-lean" product contains a lower proportion of tar than the heated steam cracked tar prior to the separating step. Similarly, "tar-rich" product contains a greater proportion of tar than does the tar-lean product. Typically, the heating is carried out to a temperature of at least about 320° C., say, at least about 350° C., e.g., to a temperature of at least about 400° C.

In an embodiment of this aspect, the lower temperature boiling range products are separated into A) at least one low temperature boiling range byproduct; and B) at least one medium temperature boiling range product whose—boiling range temperature is between that of the low temperature boiling range and the tar-rich product. The low temperature boiling range product can contain less than about 1 wt % asphaltenes, say, from about 0 to about 0.5 wt % asphaltenes. The medium temperature boiling range product can contain less than about 5 wt % asphaltenes, say, from about 0 to about 3 wt % asphaltenes. The tar-rich product typically contains at least about 5 wt % of asphaltenes, say, from about 5 to about 50 wt % asphaltenes.

In another embodiment of this aspect of the invention, the separation is carried out such that the concentration of asphaltenes in the tar-rich product is substantially the same as in the steam cracked tar.

In still another embodiment of this aspect of the invention, the process further comprises c) adding at least a portion of the at least one tar-lean product to the tar-rich product in an amount sufficient to reduce the viscosity of the tar-rich product.

In yet another embodiment of this aspect of the invention, the separation can be carried out by fractionation, extraction, and/or passage through a membrane.

In still yet another embodiment of this aspect of the invention, A) the low temperature boiling range product boils below about 350° C., say, from below about 300° C. and B) the medium temperature boiling range product boils in a range from about 250° C. to about 600° C., say, from about 300° C. to about 550° C.

In yet still another embodiment of this aspect, at least a portion of the tar-rich product is combusted in a partial oxidation unit.

In another aspect, the present invention relates to an apparatus for cracking hydrocarbonaceous feed, which comprises: A) a cracking zone comprising a) an inlet for receiving hydrocarbonaceous feed, and b) an outlet for removing hot cracked effluent; B) a heat-exchange zone capable of reducing the temperature of hot cracked effluent to less than about 300° C., comprising an inlet for receiving the hot cracked effluent and an outlet for removing a cooled cracked effluent; C) a separation zone of one or more separators comprising an inlet for receiving the cooled cracked effluent, at least one outlet for removing one or more lighter cuts, and at least one outlet for removing steam cracked tar; D) a heating zone capable of heating at least a portion of the steam cracked tar to a temperature above 300° C. sufficient to convert at least a portion thereof to lower boiling molecules, comprising an inlet for receiving the steam cracked tar and an outlet for removing the heated steam cracked tar and the lower boiling molecules. The heating zone is typically capable of heating the steam cracked tar to a temperature of at least about 320° C., say, at least about 350° C., e.g., at least about 400° C., or even at least about 450° C.

In one embodiment of this aspect of the invention, the at least one outlet for removing one or more lighter cuts of C) comprises an outlet for a naphtha and/or lower-than-naphtha boiling range product, and an outlet for a gas oil boiling range product.

In another embodiment, the apparatus further comprises E) at least one line from the at least one outlet for removing the lighter cuts of C) to the outlet and/or downstream of the outlet for removing the heated steam cracked tar, for directing at least a portion of the lighter cuts to the heated steam cracked tar.

In yet another embodiment, the apparatus of the invention comprises: F) an additional separation zone of one or more separators comprising an inlet for receiving at least a portion of the heated steam cracked tar and any lighter cuts added to the heated steam cracked tar in E), at least one outlet for removing one or more lighter cuts, and at least one outlet for removing steam cracked tar. The at least one outlet for removing one or more lighter cuts of F) can comprise an outlet for a gas oil boiling range product, and an outlet for a fuel oil boiling range product.

In yet still another embodiment, the apparatus of the invention further comprises: G) at least one line from at least one outlet for removing one or more lighter cuts of F), to the outlet and/or downstream of the outlet for removing the steam cracked tar, for directing at least a portion of the lighter cuts of F) to the steam cracked tar removed from F).

In another embodiment of this aspect, the apparatus of the invention comprises a line for recycling at least a portion of the heated steam cracked tar and the lower boiling molecules from D) to C).

In another embodiment, the at least one outlet for removing one or more lighter cuts of C) comprises an outlet for a gas oil boiling range product, and an outlet for a fuel oil boiling range product.

In another embodiment, the separation zone C) of the apparatus comprises a primary fractionator. The primary fractionator can comprise a) an inlet for receiving the tar-lean effluent, b) a bottoms outlet for removing fractionator bottoms, and c) at least one outlet for removing lower boiling products. The primary fractionator can further comprise d) an overhead outlet, e) an upper side outlet for removing steam-cracked naphtha and f) a lower side outlet for removing steam-cracked gas oil.

In yet another embodiment, the apparatus of the invention further comprises H) a tar knockout drum between B) and C), comprising a) an inlet for receiving cracked effluent, b) a bottom outlet for removing tar, and c) an upper outlet for directing tar-lean effluent to the primary fractionator.

In still another embodiment, the apparatus further comprises: I) a partial oxidation unit in communication with the outlet for a steam cracked tar bottoms product of C) and/or F).

BRIEF DESCRIPTION OF THE DRAWINGS

The FIG. 1 depicts a process schematic and apparatus for upgrading tars in a steam cracking plant environment, in accordance with the present invention.

DETAILED DESCRIPTION

Figure 1:
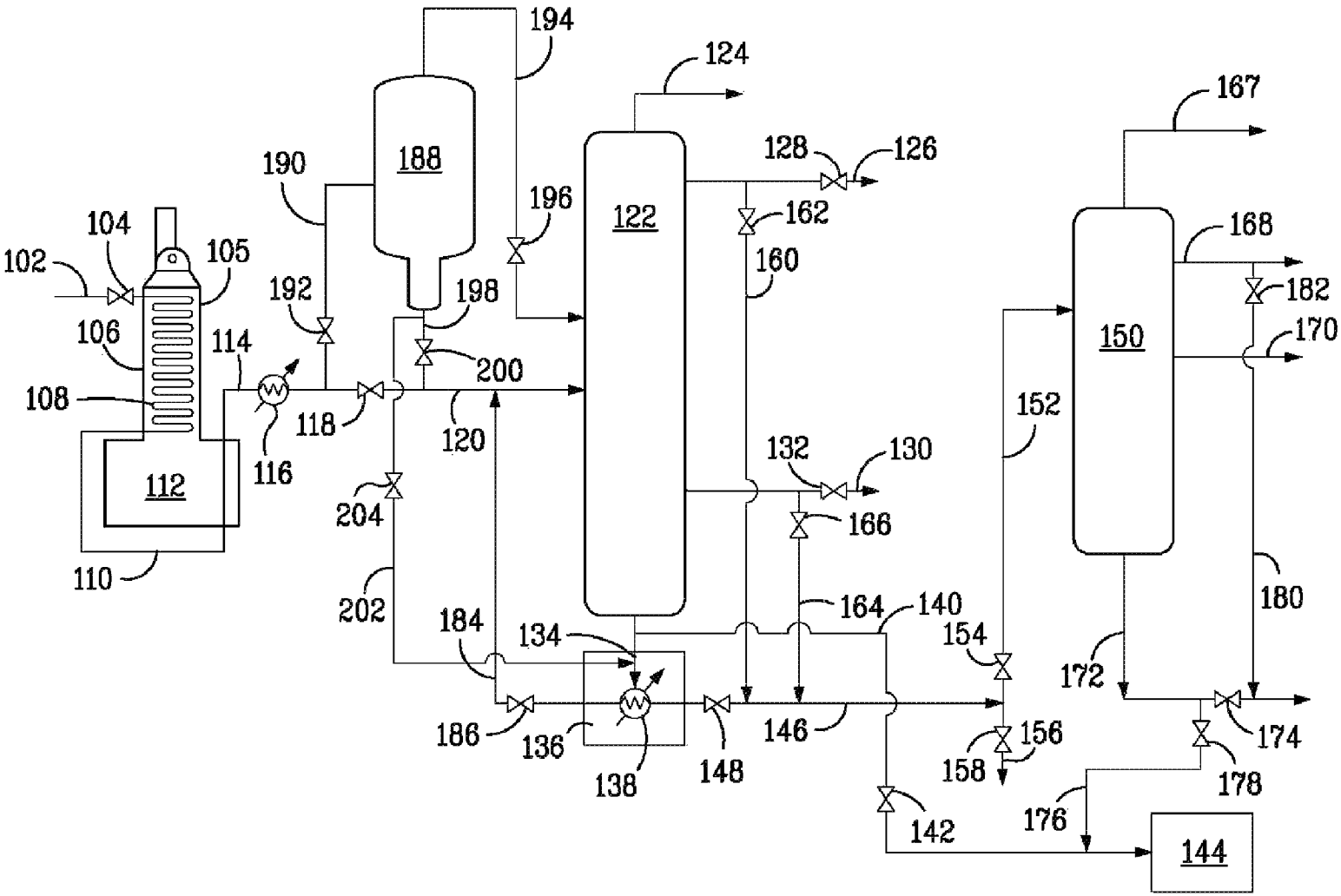

Unless otherwise stated, all percentages, parts, ratios, etc. are by weight. Ordinarily, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

Suitable hydrocarbonaceous feeds for use in the present invention include naphtha boiling range materials, as well as those boiling with a final boiling point in a temperature range from above about 180° C., such as feeds heavier than naphtha. Such feeds include those boiling in the range from about 93° C. to about 649° C. (from about 200° F. to about 1200° F.), say, from about from about 204° C. to about 510° C. (from about 400° F. to about 950° F.). Typical heavier than naphtha feeds can include heavy condensates, gas oils, kerosene, hydrocrackates, low sulfur waxy residue, crude, vacuum resid, hydrotreated atmospheric resid, hydrotreated vacuum resid, hydrotreated crude, crude oils, and/or crude oil fractions.

The hydrocarbonaceous feeds can comprise a large portion, such as from about 5 to about 50%, of relatively high-boiling components, i.e., resid. Such feeds could comprise, by way of non-limiting examples, one or more of steam cracked gas oils and residues, gas oils, heating oil, jet fuel, diesel, kerosene, gasoline, catalytically cracked naphtha, hydrocrackate, reformate, raffinate reformate, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixture, naphtha/residue admixture, hydrocarbon gases/residue admixture, hydrogen/residue admixtures, gas oil/residue admixture, and crude oil. Suitable whole crude oils include those containing high levels of nickel and vanadium such as found in Venezuela tars, for example. Solvent deasphalted (or deashpaltened) (SDA) fractions with and without resins, are especially suited for use as feedstocks in the present invention. The foregoing hydrocarbonaceous feeds can have a nominal end boiling point of at least about 315° C. (600° F.), generally greater than about 510° C. (950° F.), typically greater than about 590° C. (1100° F.), for example, greater than about 760° C. (1400° F.).

Asphaltenes in steam cracked tar can be determined quantitatively as the insolubles in paraffinic solvents. Steam cracked asphaltenes generally are composed of carbon, hydrogen, nitrogen, sulfur with a C:H atomic ratio of about 2.0-1.0 and average molecular weight of about 1000. They are brownish solids having a vaporization/decomposition temperature starting at about 350° C. to about 400° C. as determined by thermogravimetric analysis in nitrogen (heating rate 10° C./minute).

Among the wide range of paraffin insolubles which are formed upon heating and oxidation, the pentane-insolubles and heptane-insolubles, hereinafter designated as $C_5$-asphaltenes and $C_7$-asphaltenes, are of particular interest. Asphaltenes may be specified with reference to the particular paraffins in which they are insoluble, e.g., n-heptane, n-hexane, n-pentane, isopentane, petroleum ether, etc. For present purposes, asphaltene content of a sample can be determined by well-known analytic techniques, e.g., ASTM D6560 (Standard Test for Determination of Asphaltenes (Heptane Insolubles) in Crude Petroleum and Petroleum Products), ASTM D3270 (Standard Test Method for n-Heptane Insolubles), ASTM D4055-02 Standard Test Method for Pentane Insolubles by Membrane Filtration, and ASTM D-893, Standard Test Method for Insolubles in Used Lubricating Oils.

The hydrocarbonaceous feed may be initially heated by indirect contact with flue gas in a convection section tube bank of the pyrolysis furnace (or cracking furnace) before mixing with a dilution fluid, e.g., steam. Preferably, the temperature of the heavy hydrocarbonaceous feedstock is from about 149° C. to about 260° C. (300° F. to 500° F.) before mixing with the dilution fluid, preferably water and steam.

Following mixing with the primary dilution steam stream, the mixture stream may be heated by indirect contact with flue gas in a first convection section of the pyrolysis furnace before being flashed. Preferably, the first convection section is arranged to add the primary dilution steam stream, between subsections of that section such that the hydrocarbonaceous feeds can be heated before mixing with the fluid and the mixture stream can be further heated before being flashed.

The temperature of the flue gas entering the first convection section tube bank is generally less than about 816° C. (1500° F.), for example, less than about 704° C. (1300° F.), such as less than about 621° C. (1150° F.), and preferably less than about 538° C. (1000° F.).

Dilution steam may be added at any point in the process, for example, it may be added to the hydrocarbon feedstock before or after heating, to the mixture stream, and/or to the vapor phase. Any dilution steam stream may comprise sour steam. Dilution steam stream may be heated or superheated in a convection section tube bank located anywhere within the convection section of the furnace, preferably in the first or second tube bank.

The mixture stream may be at about 316° C. to about 538° C. (600° F. to 1000° F.) before introduction to an optional vapor/liquid separator or flash apparatus, e.g., knockout drum, situated between the convection section and the radiant section of the furnace. The flash pressure can be any suitable pressure, e.g., about 40 to about 200 psia (275 to 1375 kPa). Following the flash, 50 to 98% of the mixture stream can be in the vapor phase. The vapor phase can be heated above the flash temperature before entering the radiant section of the furnace, for example, to about 427° C. to about 704° C. (800° F. to 1300° F.). This heating may occur in a convection section tube bank, preferably the tube bank nearest the radiant section of the furnace, in the lower convection zone.

The temperature of the gaseous effluent at the outlet from the radiant section of the pyrolysis reactor is normally in the range of from about 760° C. to about 929° C. (1400° F. to 1705° F.). The hot gaseous effluent is cooled by a suitable heat exchange means, e.g., a transfer line exchanger and/or supplemental heat exchanger to a temperature below 300° C. (572° F.), e.g., a temperature below 280° C. (536° F.), or even below 270° C. (518° F.).

The resulting cooled, cracked effluent can be directed to a suitable separation means such as a tar knockout drum prior to further processing in a separation zone. The flash pressure utilized can be any suitable pressure, e.g., from about 15 to about 200 psia (101 to 1374 kPa). The overhead of the tar knockout drum, containing molecules having boiling points less than about 300° C., can be directed to a separation means for further processing, e.g., to a primary fractionator. The bottoms containing tar can be disposed of or directed to a suitable separation means for further processing, e.g., to a primary fractionator. In one embodiment, the bottoms containing tar from the tar knockout drum can themselves be used as at least a portion of the cooled steam cracked tar which is heated from below 300° C. to a temperature above 300° C. in accordance with the invention.

The cooled, cracked effluent from the heat exchange means downstream of the pyrolysis reactor can be directly taken to a separation zone (bypassing the tar knockout drum, if present). The separation zone can comprise one or more fractionators, one or more extractors, one or more membranes, or combinations thereof. Preferably, the separation zone comprises a primary fractionator. The separation zone divides the stream into one or more lighter cuts, e.g., steam cracked naphtha boiling in a range from about 10° C. to about 250° C. (50° F. to about 482° F.), say, from about 25° C. to about 210° C. (77° F. to about 410° F.), and steam cracked gas oil, boiling in a range from about 200° C. to about 300° C. (392° F. to about 572° F.), say, from about 210° C. to about 295° C. (410° F. to about 563° F.), as well as a heavy steam cracked tar-rich fraction, typically boiling above about 300° C. (572° F.).

The resulting steam cracked tar fraction is collected at a temperature below 300° C. (572° F.), e.g., a temperature below 280° C. (536° F.), or even below 270° C. (518° F.). This cooled steam cracked tar is then treated in accordance with the present invention to enhance its value. This can be done by reducing the ultimate yield of low value steam cracked tar from the process while obtaining increased yields of lighter, more valuable fractions, such as steam cracked gas oil, low sulfur fuel oils, or streams compatible therewith. Moreover, the remaining steam cracked tar provided by the present invention can be reduced in asphaltene content and viscosity. Such reduction in viscosity reduces or eliminates the amount of lower viscosity, higher value flux materials, e.g., steam cracked gas oil, that is necessary to upgrade the steam cracked tar to specification. Additional upgrade value can be achieved by splitting the remaining tar into a light stream and a heavy stream, where the light stream can be blended into fuel oil without causing incompatibility problems for the resulting blended fuel oil. While not wishing to be bound by theory, applicants believe the present invention treats the cooled steam cracked tar by heating to a temperature sufficient to crack or otherwise modify asphaltenes and asphaltene precursors into lower boiling molecules.

In a simplified aspect, the present invention comprises upgrading steam cracked tar containing asphaltenes that comprises two steps: a) heating steam cracked tar from below 300° C. to a temperature above 300° C. and for a time, that suffice to convert at least a portion of the steam cracked tar to lower boiling molecules; and b) separating the heated steam cracked tar of a) into i) at least one tar-lean product; and ii) a tar-rich product. The tar-lean product contains a lesser proportion of tar by weight than the steam cracked tar that is to be upgraded, say, at least about 5 wt % less, typically at least about 25 wt % less, e.g., at least about 50 wt % less. Similarly, the tar-rich product contains a greater proportion of tar by weight than the steam cracked tar that is to be upgraded, say, at least about 5 wt % more, typically at least about 25 wt % more, e.g., at least about 50 wt % more. The cooled steam cracked tar can be derived from hot gaseous effluent from a steam cracking furnace, which has been cooled, e.g., by heat exchange, and separated to provide a stream rich in tar, say, at least about 10 wt %, typically, at least about 25 wt % tar.

First, the cooled steam cracked tar, typically obtained from a tar knockout drum and/or separation zone, as discussed above, is heated at a temperature, pressure, and a time sufficient to convert at least a portion to lower boiling molecules. For present purposes, such a portion can be that part of the steam cracked tar whose conversion to lower boiling molecules can be measured using techniques known to those skilled in the art, e.g., gas chromatography or infrared spectroscopy. Such a portion can range from about 0.01 wt % to 100%, typically from about 1 wt % to 100 wt %, say, from about 50 wt % to about 100 wt %, of the steam cracked tar stream that is heated. Such heating is typically carried out downstream of the separation zone and/or tar knockout drum with a suitable heat transfer means, e.g. a furnace, to provide the required heat. Typically, the steam cracked tar can be heated to a temperature above 300° C. (572° F.), say, above about 320° C. (608° F.), or even above about 350° C. (662° F.), at a pressure ranging from about 0 to about 2748 kPa (15 psig to about 400 psig), say, at a pressure ranging from about 101 to about 788 kPa (0 psig to about 100 psig), and for a period of time of at least about 0.01 minutes, say, ranging from about 0.01 to about 1200 minutes, typically from about 0.1 to about 120 minutes, or more particularly, from about 1 to about 60 minutes. The amount of time necessary to effect the desired conversion of steam cracked tar to lower boiling molecules can vary depending on such factors as the temperature to which the steam cracked tar is heated, pressure during heating, and the rate of heat transfer to the steam cracked tar, etc. during heating. Thus, if the heating is to occur under flashing conditions, the amount of time needed would be less than that required under, say, heat soak conditions.

Once the steam cracked tar is sufficiently heat treated to reduce asphaltene and other tar molecules content, the heat-treated steam cracked tar can be collected as an asphaltene-reduced tar. Preferably, the stream containing heat-treated tar is directed to a suitable separating means, e.g., a primary fractionator, extractor and/or membrane which divides the stream into a plurality of product streams, including a lower temperature boiling range product and a higher temperature boiling range product, the latter containing a tar component. In a typical embodiment, the product streams include at least 1) a steam cracked gas oil (SCGO) stream, boiling in a range from about 200° C. (392° F.) to about 310° C. (590° F.), say, from about 210° C. (410° F.) to about 295° C. (563° F.), 2) a low sulfur fuel oil (LSFO)-compatible stream boiling in a range from about 300° C. (572° F.) to about 510° C. (950° F.), say, from about 310° C. (590° F.) to about 482° C. (900° F.), and 3) a residual stream containing at least about 5 wt % asphaltenes, boiling above about 300° C. (572° F.). In the event it is desired to produce a tar stream similar to one obtained without heat-treating according to the invention, the residual stream can be fluxed with a lighter boiling fraction as necessary to provide a tar stream of the same or similar ratio as the non heat-treated tar. The steam cracked gas oil-cut stream of 1) can be used as the flux.

In an embodiment of the present invention depicted in FIG. 1, a hydrocarbonaceous feed stream 102, e.g., atmospheric resid or crude, is controlled by feed inlet valve 104 and the resulting feed is heated in an upper convection section 105 of a furnace 106. A steam stream and/or water stream (not shown) can be introduced to the hydrocarbons in the upper convection section. The resulting mixture is further heated in the convection section where all of the water vaporizes and a large fraction of the hydrocarbon vaporizes. Typically, this heating is carried out to a temperature up to about 454° C. (850° F.), e.g., a temperature ranging from about 204° C. to about 482° C. (400° F. to 900° F.).

Exiting upper convection section 105, the mixture stream, generally at a temperature of about 454° C. (850° F.) can enter an optional vapor/liquid separation apparatus or flash drum for use with heavy feeds (not shown) where a vapor/liquid separation occurs with heavy liquid bottoms being withdrawn.

The steam/hydrocarbon vapor from the upper convection section (or that derived from the flash drum overhead where a flash drum is used) passes from the lower convection section 108 via crossover piping 110 and through the radiant section 112 of the furnace where it undergoes cracking. The cracked effluent exits the radiant section through a quench header apparatus comprising a horizontal transfer line 114. The transfer line may itself comprise an integral heat exchange means or a separate heat exchange means 116 can substitute for or supplement the integral heat exchange means. The heat exchanger(s) reduce the temperature of the cracked effluent to a temperature less than about 300° C. (572° F.). A valve 118 controls the flow of cooled cracked effluent via line 120 to a fractionator 122. A stream containing $C_4$-hydrocarbons is taken as overhead via line 124, while steam cracked naphtha is taken as an upper side stream via line 126 controlled by valve 128, and a steam cracked gas oil fraction is taken as a lower side stream via line 130, controlled by valve 132. Steam cracked tar is taken as a bottoms fraction having a temperature below 300° C. (572° F.) via line 134 to a heating vessel 136 comprising a heating means 138, e.g., a furnace, where the steam cracked tar is heated to a temperature above about 350° C. (572° F.) with a residence time of from about 0.1 to about 60 minutes.

A portion of the steam cracked tar can be directed from line 134 via line 140 controlled by valve 142 to a partial oxidation unit (POX) 144, which is widely utilized in the chemical and petroleum industries to convert heavy hydrocarbons to synthetic gas. Thus, the steam cracked tar can be utilized as POX feedstock.

At least a portion of the heat-treated steam cracked tar is directed from line 134 via line 146 controlled by valve 148 to a separating means, e.g., fractionator 150 via line 152 controlled by valve 154. As desired, the heat-treated steam cracked tar can be collected directly from line 146 via line 156 controlled by valve 158. If necessary, the heat-treated steam cracked tar in line 146 can be diluted or fluxed with a diluent, e.g., steam cracked naphtha taken from line 128 via line 160 controlled by valve 162, and/or a steam cracked gas oil stream taken from line 130, via line 164 controlled by valve 166.

The fractionator 150 resolves the heat-treated steam cracked tar stream into an overhead stream of naphtha and lighter materials via line 167, a steam cracked gas oil stream taken as an upper sidestream via line 168 and a low sulfur fuel oil-compatible stream taken as a lower sidestream via line 170. A low value tar stream rich in asphaltenes can be collected as bottoms via line 172 controlled by valve 174. If desired, the tar stream can be directed to partial oxidizer 144 via line 176 controlled by valve 178. The low value tar stream can be fluxed by adding a diluent such as a steam cracked gas oil stream, e.g., by diverting at least a portion of the steam cracked gas oil stream to line 172 from line 168 via line 180 which is controlled by valve 182.

At least a portion of the heat-treated steam cracked tar can be recycled to the fractionator 122 via line 184 controlled by valve 186 to effect separation of lower boiling, more valuable components resulting from the heat treatment of the steam cracked tar.

Optionally, at least a portion of the cooled cracked effluent in line 120 can be diverted to a tar knockout drum 188 via line 190 controlled by valve 192. Overhead is taken from the drum and directed to fractionator 122 via line 194 controlled by valve 196. A tar fraction can be taken as bottoms via line 198 controlled by valve 200. Optionally, at least a portion of the tar fraction can be sent to the heating means 138 via line 202 controlled by valve 204.

The present invention is especially suited to economically advantageous use of steam cracked tars by heat treating them to reduce formation of asphaltenes and other tar molecules. The overall yield of tar produced by steam cracking can be reduced significantly by the invention and the tar produced can be fluxed using gas oil by-products from the invention to produce upgraded tar products.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A process for upgrading steam cracked tar containing asphaltenes that comprises:

a) heating the steam cracked tar from below 300° C. to a temperature above 300° C. and for a time, sufficient to convert at least a portion of the steam cracked tar to lower boiling molecules, without the addition of hydrogen, hydrogen donors, reducing materials or other additives to the steam cracked tar; and b) separating the heated steam cracked tar of a) into i) at least one tar-lean product; and ii) a tar-rich product boiling above the tar-lean product.

2. The process of claim 1 wherein the tar-lean product is separated into A) at least one low temperature boiling range product; and B) at least one medium temperature boiling range product.

3. The process of claim 1 wherein the separation is carried out such that the concentration of asphaltenes in the tar-rich product is substantially the same as in the steam cracked tar.

4. The process of claim 1 which further comprises:

c) adding at least a portion of the at least one tar-lean product to the tar-rich product in an amount sufficient to reduce the viscosity of the tar-rich product.

5. The process of claim 2 wherein the low temperature boiling range product contains less than about 1 wt % asphaltenes, the medium temperature boiling range product contains less than about 5 wt % asphaltenes, and the tar-rich product contains at least about 5 wt % of asphaltenes.

6. The process of claim 2 wherein the separation of the tar-lean product into the at least one low temperature boiling range product and the at least one medium temperature boiling range product is carried out by fractionation, extraction, and/or passage through a membrane.

7. The process of claim 2 wherein A) the low temperature boiling range product boils below about 350° C. and B) the medium temperature boiling range product boils in a range from about 250° C. to about 600° C.

8. The process of claim 2 wherein A) the low temperature boiling range product boils below about 300° C. and B) the medium temperature boiling range product boils in a range from about 300° C. to about 550° C.

9. The process of claim 1 wherein at least a portion of the tar-rich product is combusted in a partial oxidation unit.

10. The process of claim 1 wherein the heating is carried out to a temperature of at least about 320° C.

11. The process of claim 1 wherein the heating is carried out for a time of at least about 0.01 minutes.

12. The process of claim 1 comprising:

cracking a hydrocarbonaceous feed to produce an effluent;

cooling the effluent; and separating the effluent into an overhead stream and the steam cracked tar in a knockout drum.

13. The process of claim 1 comprising:

cracking a hydrocarbonaceous feed to produce an effluent;

cooling the effluent; and separating the effluent into two or more streams and the steam cracked tar in a primary fractionator.

* * * * *